United States Patent [19]

MacNair et al.

[11] Patent Number: 4,503,999

[45] Date of Patent: Mar. 12, 1985

[54] DISPENSING VALVE ASSEMBLY FOR A PRESSURIZED CONTAINER

[75] Inventors: Leonard I. MacNair, Greenford; Gary Fishlock, Swindon, both of England

[73] Assignee: Metal Box p.l.c., Reading, England

[21] Appl. No.: 404,775

[22] Filed: Aug. 3, 1982

[30] Foreign Application Priority Data

Aug. 6, 1981 [GB] United Kingdom ..... 8124007

[51] Int. Cl.[3] ..... B65D 83/14

[52] U.S. Cl. ..... 222/402.16; 222/402.24

[58] Field of Search ..... 222/402.22, 402.24, 222/402.2, 402.21, 394, 402.16

[56] References Cited

U.S. PATENT DOCUMENTS 3,416,770 12/1968 Green ..... 222/402.22 X
3,658,214 4/1972 Beard ..... 222/402.2
4,015,752 4/1977 Meuresch et al. ..... 222/402.21 X

*Primary Examiner*—Stanley H. Tollberg
*Attorney, Agent, or Firm*—Diller, Ramik & Wight

[57] ABSTRACT

A valve assembly for a container for pressurized fluid in which a cup (10) mounts the assembly to a container body, and a valve (14) including a valve housing (12) fitted in the cup, the valve housing is located within the cup by the engagement of internal projections (16) in the cup behind a head (18) of the housing. The cup, the valve housing (12) and the valve (14) are arranged in one condition of the valve assembly to allow fluid to be passed into the cup and between an exterior wall of the housing and the side wall of the cup for filling the container. The exterior wall of the housing is provided with a multiplicity of narrow grooves (26) which define flow paths (62) for the passage of such fluid and these grooves are narrow in relation to the width of the internal projections, so that they do not impair the locating function of the projections. The grooves extend into a collar (20) on the housing adjacent to the head, and because of their narrowness they provide extra flow paths past the projections which contact this collar, which paths cannot be blocked by the projections irrespective of the orientation of the housing relative to the cup.

9 Claims, 2 Drawing Figures

DISPENSING VALVE ASSEMBLY FOR A PRESSURIZED CONTAINER

Figure 1:
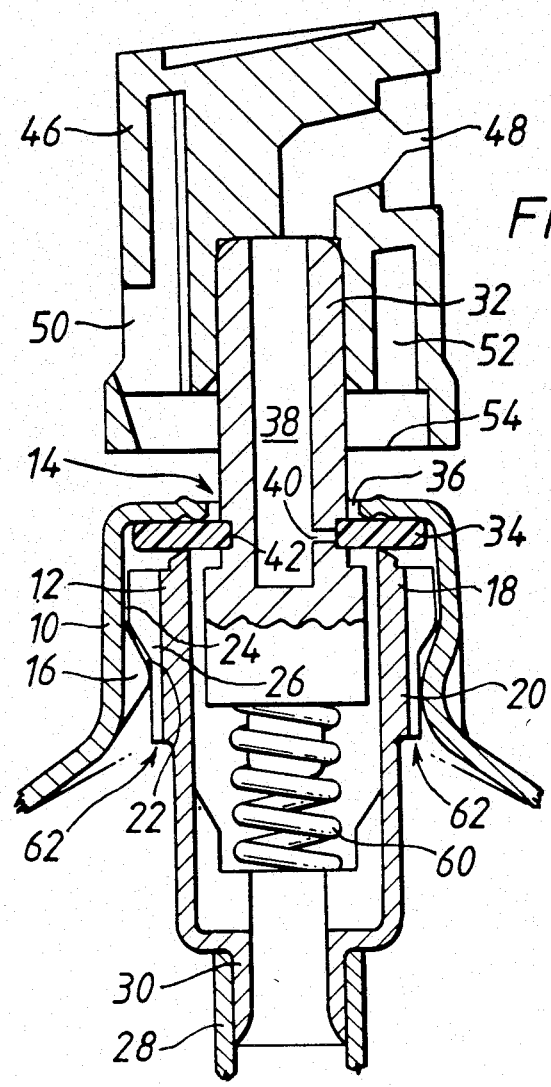

This invention concerns a valve assembly for a container for pressurised fluid, and a pressurised fluid container including such an assembly.

More particularly, the invention relates to a valve assembly for an aerosol container, for example, around which the container can be charged with a pressurising medium or propellant and through which subsequently pressurised fluid can be dispensed.

One known type of aerosol valve assembly comprises a cup mounting the assembly to the aerosol body, a valve housing fitted in the cup, and valve means supported by the cup and the valve housing. The housing has a head which is retained within the cup by crimps in the side wall of the cup engaging behind the head, and the valve means include a valve stem extending from within the housing out through the end wall of the cup and an elastomeric gasket encircling the valve stem and arranged between the head of the housing and the end wall of the cup. The valve stem is resiliently biassed into an extended position and normally holds the gasket so that it seals passages from the exterior of the cup through to the interior of the container. When the valve stem is depressed, however, the gasket is deformed to open one or more of these passages so that the container can be charged with propellant and subsequently pressurised fluid can be discharged.

For charging, the gasket is arranged to be deformed to provide a first passage from an operating button mounted on the stem into a space between the head of the valve housing and the side wall of the cup and a second passage partly in parallel to the first, which extends from the button through the interior of the housing to a dip-tube in the container. A third charging passage is available along the flow path which is used for dispensing, but in the reverse direction, that is to say, through the operating button, and the valve stem to the interior of the housing, and thence to the dip-tube. Usually, the major part of the propellant flow will occur through the first passage.

Various valve assemblies of this type have been proposed.

In one such valve assembly, disclosed in our British Pat. No. 1 534 873, the head of the valve housing is continuous, that is to say, ungrooved or unbeaded, and a small clearance is provided between the head and side wall of the cup for the passage of propellant during charging. The housing is located relative to the cup by the engagement of the crimps in the cup wall behind the head and with the body of the housing.

Another known valve assembly is a development of that just mentioned and has a substantial passage formed between the head of the valve housing and the side wall of the cup for ease of filling. In this instance, the housing is again secured relative to the cup by crimps as previously mentioned, and six equi-spaced locating ribs formed around the housing head serve to centre the head within the cup by contacting the interior of the cup. The housing has a thickened tubular portion beneath the head so as to provide a reinforcing collar or body ring which increases the rigidity of the housing enabling it better to withstand, without gross deformation, the radially inward pressures generated at the crimps, these pressures serving to restrain relative movement, primarily tilting movement, of the housing relative to the cup.

In a further development, the head of the housing and the side wall of the cup have been formed with only a narrow clearance between the two and the area of the flow-path which they define is increased by providing seven equi-spaced wide grooves in the head, the width of the grooves being approximately the same as that of the residual head regions between them. Again, location is achieved by the engagement of crimps behind the head and against a continuous reinforcing collar on the housing body. Eight crimps were provided of similar width to that of the grooves, but it was found that occassionally valve body misalignment would occur.

The difficulty with all these arrangements has been to combine a substantial flow region for aiding quick pressurisation of the container with adequate location of the valve housing so that distortion and misalignment of the housing, which result in unacceptable leakage rates after pressurisation, are avoided in use.

The continuing conflict between these two requirements has been known to those skilled in the art for very many years, and is illustrated by reference to the following earlier patent specifications, namely, U.S. Pat. No. 2,890,817, British Specification Nos. 960,544, 1,022,576, 1,132,798, 1,358,181, 1,362,885 and 1,534,873 and British Published Applications Nos. 7942558 (2040002A) and 8010112 (2049827A).

It is an aim of the present invention to further improve the filling speed of an over the housing type valve which nevertheless is very firmly located and hence has good leakage performance.

The invention provides a dispensing valve assembly for a container for a pressurised product, comprising a cup adapted for mounting the assembly to a container body, valve means including a valve housing having a head thereon which lies inside the cup, the cup being formed with internal projections which engage under the head to secure the valve housing to the cup and which also engage with a tubular portion of the valve housing adjacent to the head to restrain movement of the housing relative to the cup, and a propellant inlet arranged to permit entry of pressurised propellant fluid from outside the cup to a region between the inner surface of the cup and the exterior of the valve housing, wherein said tubular portion of the housing is formed so as to provide a plurality of flow paths along which propellant fluid from said region flows past the projections, which flow paths are sufficiently narrow, in the circumferential direction and relative to the width of the projections in that direction, that irrespective of the angular orientation of the housing relative to the cup the projections firmly engage with said tubular portion without substantially restricting said flow paths.

Thus, the firmness of location previously achieved by having the projections firmly engage with a tubular portion adjacent to the head is retained while the total flow area for incoming propellant, at the level of the projections, is increased by the provision of extra flow paths. Furthermore, because of their narrowness, none of the flow paths can ever be blocked by the projections even if projections actually overlie flow paths, and neither in the same situation is the firmness of engagement of the projections with the tubular portion significantly reduced, so that during assembly there is no need for the added step of orientating the housing relative to the cup which was resorted to in British Published Application No. 2049827A referred to above in an attempt to simultaneously improve filling speed and retain security of the valve housing in the cup.

In the embodiment to be described below, the exterior wall of the head is formed with grooves which extend into said tubular portion so as to provide said flow paths. As a result, a substantial flow area may be provided also between the housing head and the side wall of the cup. By making the grooves in the head sufficiently narrow, the crimps cannot enter into them to a substantial extent and so cause misalignment of the housing, irrespective of orientation.

Preferably, the number of grooves provided is significantly greater than six and, in the embodiment described below, there are sixteen grooves.

Figure 2:
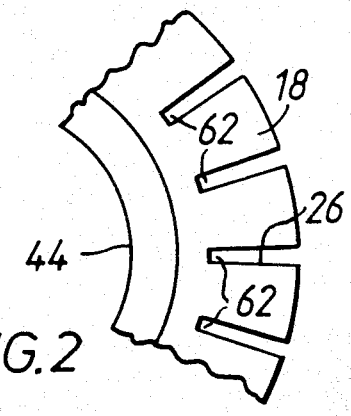

The invention is described further, by way of example, with reference to the accompanying drawings in which:

FIG. 1 is a section through a valve assembly embodying the invention in a closed condition; and FIG. 2 is a fragmentary end view of a housing of the valve assembly.

The valve assembly illustrated in the drawings comprises a sheet metal valve mounting cup 10 secured to an aerosol container body (not shown) in a conventional manner. The cup 10 carries valve means 14 including a valve housing 12.

As shown, the cup 10 is formed with a plurality of spaced projections in the form of crimps 16 which engage beneath a head 18 of the housing 12. Further engagement between the crimps and the housing occurs at a tubular portion in the form of reinforcing collar or body ring 20 at which the housing 12 is thickened beneath the head 18. These engagements are such that the housing is accurately located within the mouting cup against any substantial movement in either the axial or the radial directions, and any substantial tilting movement, as will later become more fully apparent.

A passage 22 is defined between the exterior of the housing 12 and the side wall of the cup 10 by a small clearance 24 between the periphery of the head 18 and the side wall, and grooves 26 extending continuously down both the head 18 and the body ring 20. The grooves 26 are both many and narrow and they are significantly narrower than the width of the crimps 16, so that the crimps 16 cannot penetrate into them to any substantial extent. The number and depth of the grooves 26 is sufficient to provide a substantial flow area for the passage 22. In this instance, there are 16 of the grooves 26 and they extend radially to a substantial extent into the head 18 and body ring 20. However, because of the thickening of the housing at the head 18 and body ring 20, the remanent thickness of material at the base of the grooves is nevertheless substantial and the housing remains correspondingly robust and not prone to distortion.

The housing 12 is hollow and its interior communicates with a dip-tube 28 by way of a nozzle 30.

The valve means 14 are arranged to control opening of the passage 22 and the interior of the housing 12 to the exterior of the cup 10 for pressurisation and product dispensing. For this purpose, the valve means 14 are provided with a valve stem 32 movable within the housing 12, and an elastomeric gasket 34 encircling the valve stem 32 and clamped between the housing 12 and the end wall of the cup 10 by the engagement of the crimps 16 with the housing. The valve stem 32 projects through the cup end wall and, with this end wall, defines an annular propellant inlet opening 36 into the cup. Additionally, the valve stem contains a bore 38 which communicates with an aperture 40 extending through the wall of the stem to an annular seat 42 for receiving the inner periphery of the gasket 34. The stem 32 is resiliently biassed outwardly of the cup 10 (i.e. upwardly as shown) by a spring 60 and thus normally occupies the position illustrated in FIG. 1 in which the gasket is flat and closes both the annular opening 36 and the aperture 40.

When the valve stem 32 is depressed into the cup 10, the inner periphery of the gasket 34 is deformed downwardly and outwardly so as to open the aperture 40 and provide a passage between the interior of the housing 12 and the bore 38 via the aperture 40. This passage is the passage used for product dispensing; it also serves in the reverse direction during pressurisation of the container, when it is one of three passages available for propellant flow into the container.

Depression of the valve stem 32 is effected by operation of the button 46 mounted on the outer end of the stem 32. As shown, the button 46 is provided with a discharge aperture 48 in communication with the bore 38 and with a pressurising aperture 50 which opens into an annular region 52 of the button 46 in communication with an annular opening 54 in the base of the button. The opening 54 is arranged to overlie the opening 36 between the cup 10 and valve stem 32 when the stem is depressed to bring the button 46 into engagement with the cup 10.

Operation of the assembly is as follows:

For pressurising the container, previously filled with the liquid product to be dispensed, the button 46 is pressed by a pressurising head into contact with the cup 10 and a propellant in a liquid or gaseous phase is supplied by the head to the apertures 48 and 50. The propellant injected through the aperture 48 passes along the passage mentioned above, that is, by way of the aperture 40 into the interior of the housing 12 and through the dip-tube 28 into the container. A much greater flow of propellant enters the container from the annular region 52 and via the annular opening 36. The major part of this flow through the opening 36 enters the region between the inner surface of the cup and the exterior of the valve housing, and in particular passes along the interface between the gasket 34 and the end wall of the mounting cup 10 whence it flows through to the headspace of the container via the passage 22 provided between the housing 12 and the side wall of the cup 10 as previously mentioned; flow of the propellant past the gasket is facilitated by downward deformation of the outer periphery of the gasket in response to the propellant pressure, this deformation occurring outside a knife edge 44 at which the housing supports the gasket. The remainder of the propellant flow through the opening passes to the dip-tube 28 past the inner edge of the gasket and the interior of the housing.

Once pressurisation is complete, the button 46 is released, so allowing the stem 32 to return resiliently to its normal position in which the gasket 34 seals the container. Thereafter, the container may be used in conventional manner to dispense products by depressing the button so as to open the aperture 40 and allow product to be discharged through the aperture 48 via the dip-tube 28, the interior of the housing, and the stem bore 38.

Rapid pressurisation of the container is possible as a result of combined flow through the inside of the housing and between the housing and the cup; the speed of pressurisation is enhanced by the substantial flow area presented by the passage 22.

It is particularly to be noted that at the level of the crimps 16 the grooves 26 provide a substantial flow-path between the housing 12 and the cup 10 in the form of a multiplicity of small individual flow paths at positions 62 in FIG. 2. As already discussed, these flow paths do not impair the location of the housing in the assembly since they are not sufficiently wide to accommodate any substantial part of the crimps 16. For the same reason, they can never be restricted by the crimps to any substantial extent, irrespective of the relative orientation of the housing and the cup, so the extra flow area they provide will always be available.

In the embodiment described, sixteen grooves are provided. However, this particular number is not essential, and other numbers of grooves may be used; preferably, significantly more than six grooves are provided. Preferably the grooves are equi-spaced and extend continuously along the whole length of the head 18 and body ring 20 as shown.

The valve assembly just described enables a container to be charged with 100 grams of a liquid fluorocarbon propellant at least 20% faster than when either of the two above-mentioned developed forms of the assembly shown in British Pat. No. 1 534 873 are employed. Its leakage characteristics after charging are significantly better than those of the second of those previous valve assemblies.

We claim:

1. A dispensing valve assembly for a container for a pressurised product, comprising a cup adapted for mounting the assembly to a container body, valve means including a valve housing having a head thereon which lies inside the cup, the valve means further including a resilient sealing member located between the head and an end wall of the cup, the cup having a side wall formed with radially inwardly extending internal projections which engage an undersurface of the head to urge the valve housing axially against the sealing member and thereby hold the sealing member in compression against the end wall of the cup, the internal projections having crests at their radially inward extremities the valve housing further having a tubular portion which is integral with and coaxial with the head and which extends axially away from the head beyond the said undersurface thereof, the tubular portion having a radially outer surface which is substantially cylindrical, the internal projections engaging the said substantially cylindrical radially outer surface with their crests so as to restrain movement of the housing relative to the cup in the radial direction, there being a propellant inlet arranged to permit entry of pressurised propellant fluid from outside the cup to a region between the inner surface of the cup and the exterior of the valve housing, wherein said tubular portion of the housing is formed so as to provide a plurality of flow paths along which propellant fluid from said region flows past the projections, which flow paths are sufficiently narrow, in the circumferential direction and relative to the width of the projections in that direction, that irrespective of the angular orientation of the housing relative to the cup the crests of the projections engage with said substantially cylindrical radially outer surface without substantially restricting said flow paths but sufficiently firmly so as, in combination with the said engagement of the internal projections with the said undersurface of the head, to secure the housing against movement within the cup in properly positioned relation thereto.

2. An assembly as claimed in claim 1 wherein the number of said flow paths is substantially greater than the number of projections.

3. An assembly as claimed in claim 1 wherein there are sixteen said flow paths.

4. An assembly as claimed in claim 3 wherein there are eight projections.

5. An assembly as claimed in any of claims 1 to 4 wherein the head is formed with grooves which are substantially narrower than said projections and which extend into the tubular portion so as to provide said flow paths.

6. An assembly as claimed in claim 5 wherein the grooves extend continuously along the whole lengths of the head and the tubular portion.

7. A dispensing valve assembly for a container for a pressurised product, comprising a cup adapted for mounting the assembly to a container body, valve means including a valve housing having a head thereon which lies inside the cup, the valve means further including a resilient sealing member located between the head and an end wall of the cup, the cup having a side wall formed with radially inwardly extending internal projections which engage an undersurface of the head to urge the valve housing axially against the sealing member and thereby hold the sealing member in compression against the end wall of the cup, the internal projections having crests at their radially inward extremities, the valve housing further having a tubular portion which is integral with and coaxial with the head and which extends axially away from the head beyond the said undersurface thereof, the tubular portion having a radially outer surface which is substantially cylindrical, the internal projections engaging the said substantially cylindrical radially outer surface with their crests so as to restrain movement of the housing relative to the cup in the radial direction, there being a propellant inlet arranged to permit entry of pressurized propellant fluid from outside the cup to a region between the inner surface of the cup and the exterior of the valve housing, propellant fluid being able to flow from said region, and between the projections, to the region beyond the projections, the tubular portion itself being formed with flow paths to enhance said flow, said housing is angularly unorientated in relation to the cup; the flow paths in the tubular portion have no predetermined angular relationship with the projections; and the flow paths are sufficiently narrow, in the circumferential direction and relative to the width of the projections in that direction, that irrespective of the angular position of the housing relative to the cup the crests of the projections engage with said substantially cylindrical radially outer surface without substantially restricting said flow paths but sufficiently firmly so as, in combination with the said engagement of the internal projections with the said undersurface of the head, to secure the housing against movement within the cup in properly positioned relation thereto.

8. An assembly as claimed in claim 1 wherein said head is of a first predetermined peripheral dimension, said tubular portion is of a second predetermined peripheral dimension substantially less than said first predetermined peripheral dimension, a transition annular shoulder establishing an area between said head and said tubular portion, said internal projections engage said tubular portion beneath said annular shoulder and substantially entirely about the peripheral extent thereof, and said plurality of flow paths are also formed in said head.

9. An assembly as claimed in claim 8 wherein each said flow path is of a greater radial depth in said head as compared to the radial depth of each flow path in said tubular portion.

* * * * *